US005605391A

United States Patent [19]

Wood

[11] Patent Number: 5,605,391

[45] Date of Patent: Feb. 25, 1997

[54] CONVECTION ROTATED ORNAMENT

[76] Inventor: Peter M. Wood, 1445 Church St., Ventura, Calif. 93001

[21] Appl. No.: 653,459

[22] Filed: May 24, 1996

[51] Int. Cl.[6] ..... F21V 21/30

[52] U.S. Cl. ..... 362/35; 362/294; 362/356; 362/444; 40/441

[58] Field of Search ..... 362/35, 96, 294, 362/352, 354, 355, 356, 373, 444, 806, 811, 325; 40/440, 441

[56] References Cited

U.S. PATENT DOCUMENTS 2,511,394 6/1950 Wynnyk .
3,263,353 8/1966 Quinn .
3,435,201 3/1969 Kemenczky .

FOREIGN PATENT DOCUMENTS 527240 10/1940 United Kingdom .

*Primary Examiner*—Y. My Quach
*Attorney, Agent, or Firm*—Terrance L. Siemens

[57] ABSTRACT

A spinning ornamental incandescent bulb cover has a shade portion and a spinning turbine vane portion formed from a single flat sheet of flexible material. Convective air currents, generated by the heat of the bulb, are passed over the turbine vanes to rotate the entire shade. No internal or external support frame structure is required for the shade or the turbine vanes. The turbine vanes meet at a common central point at which there is located a downwardly directed needle which rides in a bearing to allow rotation. The bearing is provided by a small cup held by a spring which engages the bulb. The needle point support also provides for automatic vertical alignment of the shade regardless of the orientation of the needle. The overall shape of the shade is frustoconical so as to converge the convective air currents and increase their velocity relative to the turbine vanes. The turbine vanes have a varying angle of attack in the radial direction for increased efficiency.

8 Claims, 3 Drawing Sheets

CONVECTION ROTATED ORNAMENT

REFERENCE TO RELATED APPLICATION

This application is related to Ser. No. 08/172,184, filed Dec. 23, 1993, now abandoned.

BACKGROUND OF THE INVENTION

1. Field of the Invention

The present invention relates to a moving ornament. More specifically, it relates to a rotating ornament suitable for mounting on an electric light bulb. The ornament is rotated by the heat energy normally wasted by the associated light bulb. This heat energy warms the air surrounding the bulb and creates convective air currents in a well known manner. My invention utilizes these air currents to spin a decorative lamp shade. The broad fields of architecture and advertising are seen as having potential applications for this improved ornament invention, as well as the more obvious field of consumer holiday decoration.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Devices for providing decorative lighting and lamp shades are old and well known in the art. The integration of movement into such lighting is also common. Phased multiple light advertising signs are examples of creating the appearance of movement in a lighted device without actually moving anything. Some startling and dramatic displays have been built using phased multiple neon tubing. Many examples of lamp shades may be found in which a static decorative ornamental appearance may be imbued upon a bare light bulb. However, the examples of providing dynamic lighting features by the provision of a moving lamp shade are rare although some moving lamp shades have been developed. In accordance with conventional terminology, the term lamp shade used herein may be taken to mean any transparent, translucent, or opaque material arranged between the eyes of a viewer and a light source so as to provide a change in the perceived light. The following known prior art has been directed to providing some sort of moving display which is associated with a light source. As will be seen, improvements and effectiveness of my invention are not rivaled in the prior art.

U.K. Pat. No. 527,240, dated Oct. 4, 1940, the applicants being Platers & Stampers, Ltd., describes a shade suitable for mounting on a lamp bulb and being convection driven while mounted thereon. The shade is balanced upon a stationary pin projecting upwardly from the bulb. By contrast, in my invention, the pin is part of the shade, and projects downwardly to be seated in a bearing. The novel arrangement both changes dynamic performance characteristics of the shade and also has safety implications related to the retracted location of the sharp pin.

The subject device of the U.K. patent also engages the light bulb in a manner which tends to insulate the engaged portion of the bulb. Ensuing concentration of heat may affect the life of the support, which is paper or an equivalent material. By contrast, the present invention is designed to engage the bulb more effectively with no more contact area. Whereas the support of the U.K. device surrounds the entire upper part of the bulb, the novel device partially surrounds a light bulb by coiling a wire around the bulb.

A significant degree of support is derived from coils spaced apart from adjacent coils. There is less insulating effect possible with the novel device, and consequently potentially less heat build up to reduce the life of the device. The coiled wire also enables a bearing to be readily installed and removed. This enables both ready insertion of the bearing during initial assembly and replacement, if the latter should be desired. A comparable bearing in the U.K. device is much harder to replace.

U.S. Pat. No. 3,435,201, issued to Kemenczky on Mar. 25, 1969, shows a heat-rotated illuminated ornament. The ornament requires a special incandescent bulb shield with a bearing dimple formed therein for its operation, or alternatively, requires that a comparable dimple be formed in an external support mounted to the bulb. In addition, the Kemenczky device requires this external support frame to maintain verticality. By contrast, the device of the instant invention is immediately attachable to a variety of commonly existing bulbs and requires no external support frame.

U.S. Pat. No. 3,263,353, issued to John P. Quinn on Aug. 2 1966, describes a rotatable lamp shade propelled by convective currents. Quinn's rotatable member is supported on an upwardly directed pin formed integrally with a wire having a coiled section for engaging the bulb of a lamp. By contrast, the present invention anchors a member corresponding to the pin in the rotated member, and downwardly oriented, so that it is partially obscured within the rotated member.

U.S. Pat. No. 2,511,394, issued to Wynnyk on Jun. 13, 1950, shows a decorative attachment for a lamp shade. The attachment is made to rotate by convective heat currents created by a light bulb similar to my device. However, my device forms the actual lamp shade and not a superficial attachment in addition to a lamp shade as is taught by Wynnyk. This seemingly insignificant difference leads to major structural and esthetic advantages for my arrangement which will be more fully developed later. In addition, the Wynnyk device requires an external support frame around the outside of the rotating structure. By contrast, my device requires no external support frame.

None of the above inventions and patents, taken either singly or in combination, is seen to describe the instant invention as claimed.

SUMMARY OF THE INVENTION

Briefly, the invention comprises a spinning lamp shade which is powered by the waste heat from the bulb of the lamp. The rising air currents created by the bulb are directed so as to impinge upon angularly directed vanes and thus impart angular momentum to a decorative lamp shade integral with the vanes. A vertically projecting needle is removably attached to the shade to seat within a central bearing which, in turn, supports the shade and vane apparatus. The shade and vane apparatus is die cut from a pliable single flat sheet of material and held in a frustoconical form by the pinning of several points on the sheet at the center at the top of the shade. The needle is anchored to the shade at this center, and depends therefrom.

Preferably, a rivet or similar article is employed both to pin the sheet as described above, and also to provide the needle. This becomes particularly advantageous where suitable rivets are commercially available. No new or separate component need be provided where such a rivet is employed.

A support engaging the bulb and supporting the shade by receiving the needle is provided by a wire coiled about the light bulb. The spring has an expanded section for engaging the bulb, and a tightly wound secton for securely supporting a bearing. A cup is resiliently held within the coiled wire, and forms the bearing receiving the point of the needle. The cup is manually pressed into and removed from the wire support. This enables ready replacement of the bearing cup.

The cup has a broad, flat floor surface which both affords additional space or area for the needle, thereby compensating for possible inclination of the bulb, and also enables the needle to travel randomly thereover when the cup is horizontally oriented, thereby reducing localized wear to the bearing.

The point of contact with the cup or bearing is much lower with respect to the shade than occurs for example in the U.K. device. A consequence of this arrangement is that dynamic stability is improved over the U.K. device. This is a desirable attribute since in some applications, notably when employed with light bulbs mounted tenuously upon Christmas trees and the like, the bulb may be susceptible to swaying and to transient air currents.

A significant advantage of the novel arrangement is that the needle is contained within the shade, which partially surrounds the point of the needle. and also visually obscures the needle. This sheltered location has a greater tendency to protect a user's fingers from contact with the sharp point of the needle. Even the partial obscurity of the needle may prove a boon in reducing likelihood of attracting the attention of children, who might otherwise become interested in the needle and sustain injury by puncture or the like.

Accordingly, it is a principal object of the invention to provide a new and improved convection rotated ornament device which overcomes the disadvantages of the prior art in a simple but effective manner.

It is a major object of this invention to provide a convection rotated ornament for incandescent light bulbs which is easily attached to existing bulbs without the use of tools.

It is another object of the invention to provide a convection rotated ornament for incandescent light bulbs which covers the attached bulb completely, in the manner of a lamp shade, thus substantially altering the ornamental and lighting effect of the combination.

A further object of the invention is to improve stability of the ornament.

It is again an object of the invention to protect users from ready access to the sharp point of the needle.

Yet another object of the invention is to enable ready replacement of the bearing.

It is another object of the invention to provide a convection rotated ornament for incandescent light bulbs which is rotated by convective air currents generated by waste heat from an associated incandescent light bulb.

A further object of the invention is to employ a commercially available article to assemble the invention and to assist in forming an effective pivoting bearing.

It is another object of the invention to provide a convection rotated ornament for incandescent light bulbs which is formed as a lamp shade and is rotated about a single needle bearing at the central part of the top of the shade.

It is another object of the invention to provide a convection rotated ornament for incandescent light bulbs which is formed as a lamp shade and requires no external support frame structure.

It is another object of the invention to provide a convection rotated ornament for incandescent light bulbs which is formed as a lamp shade and requires no internal support frame structure.

It is still another object of the invention to provide a convection rotated ornament for incandescent light bulbs which is formed as a frustoconical lamp shade with its larger cross sectional area at its bottom so as to serve as a converging funnel for air currents as they pass upward and to thereby increase the velocity of the air currents and to maximize their momentum and the propulsive force for rotation.

It is another object of the invention to provide a convection rotated ornament for incandescent light bulbs which is formed as a lamp shade and which is solely supported upon a needle point and is thus naturally and perpetually aligned in a vertical plane so as to maximize the vertical convective air currents providing the propulsive force for rotation.

It is another object of the invention to provide a convection rotated ornament for incandescent light bulbs which is formed as a lamp shade with integral turbine vanes across its top and which vanes are formed so as to have a greater angle of incidence with vertically directed air currents nearer the outer radius of the vanes thus creating an efficient turbine for maximizing the rotative effect of the air currents.

It is another object of the invention to provide a convection rotated ornament for incandescent light bulbs which is formed as a lamp shade and which is made of a translucent or transparent decorated material to allow the light from the associated light bulb to pass through, creating a moving lighted display on the surroundings.

It is a further object of the invention to provide a spring which engages both the bulb and supports the bearing.

Yet another object of the invention is to provide bearing means accommodating tilting of the bulb, and mitigating wear to the bearing.

It is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
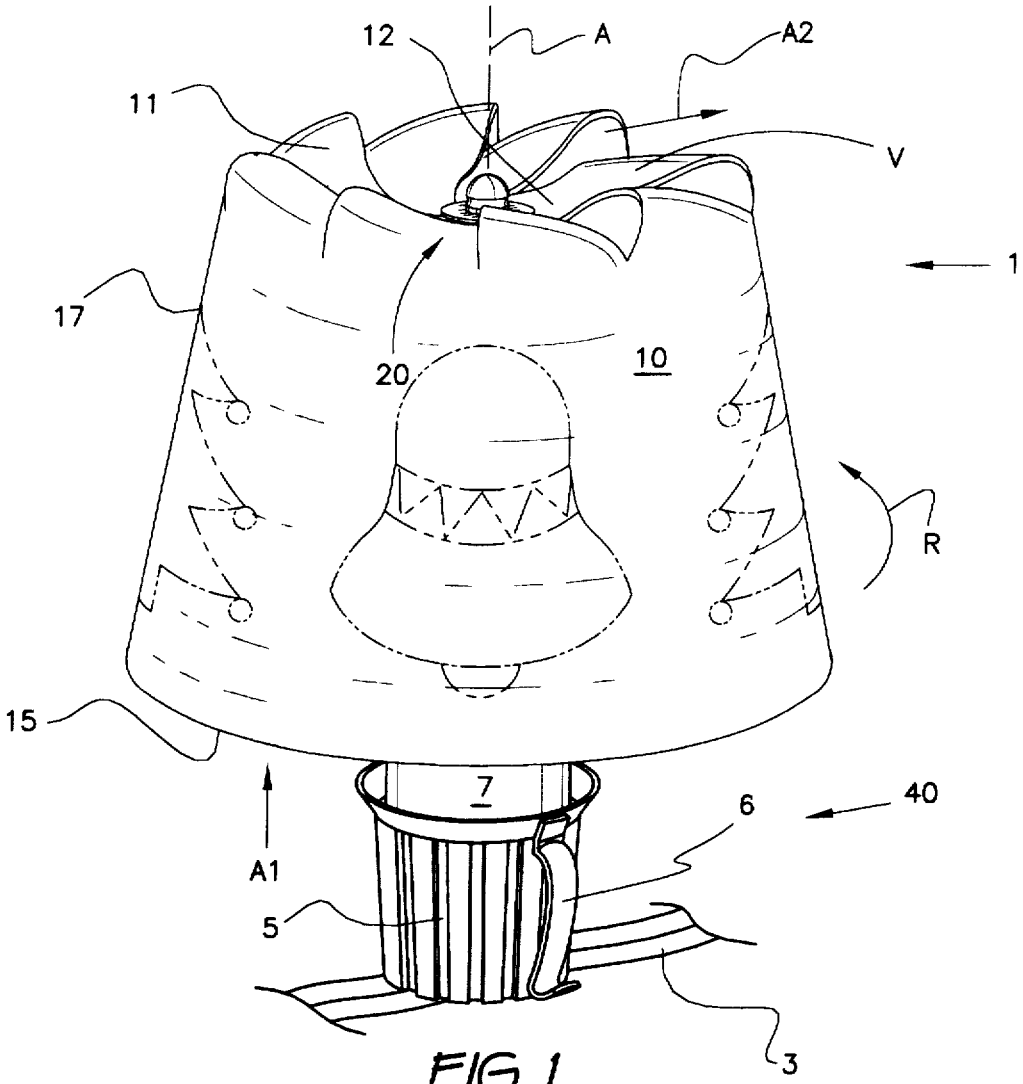
FIG. 1 is a perspective environmental view of the invention attached to a representative bulb of a conventional string of lights.

The convection rotated ornament of the present invention is generally designated by arrow 1 of FIG. 1. The device comprises the following main parts; shade and vane portion 10, needle and rivet assembly 20, needle support assembly 30 (see FIG. 2), and conventional incandescent bulb parts 40.

The conventional bulb parts 40 are shown in detail here only to illustrate one preferred environment in which the invention can be used. Electrical plug (not shown) supplies voltage through wire 3 and fused switch (not shown) to bulb receptacle 5. Receptacle 5 includes mounting clip 6 for connection to a Christmas tree limb. Of course clip 6 could be placed over any other convenient hanging point on the article to be decorated by the device. Also, it will be obvious to the artisan that receptacle 5 could form a free standing support such as found on decorative electric candle lamps. It is important to note at the outset that the bulb need not be supported in a perfectly vertical orientation for the proper operation of the device. Substantial canting or tilting of the bulb is permissible so the clip 6 need not be adjustable in any way.

Bulb 7 is lit by electrical energy from plug (not shown) in the conventional manner. It is well known that a light bulb produces a considerable amount of waste heat as it is operated. This invention takes advantage of the convective air currents generated by that heat.

As bulb 7 warms the surrounding air its density is decreased and the lower density air begins to rise by virtue of its buoyancy with respect to the denser outer air. This causes an updraft in the direction of arrow A1 which is captured in lower opening 15 of shade 10. The velocity of the air flow is increased as it rises in the shade by virtue of the fact that the cross sectional area of the conical shade decreases in the upward direction. At the top of the shade 10 the air flow impinges on the vanes V and it is deflected generally in the direction of arrow A2. This change in the direction of the air flow represents a change in velocity of the air stream which has been caused by the vanes. The vanes are urged in the opposite direction by the reaction to the impulse which redirected the air and the entire shade and vane portion 10 is urged to turn about vertical axis A.

Integral shade and vane portion 10 will now be described in detail. As seen in FIG. 1, the overall shape of the formed shade and vane portion is frustoconical with a large open lower circular area 15 and smaller upper circular area (not shown) which is partially closed by vanes V. Vanes V are bent so that angled air passages exist for heated air to escape from the top of the shade after being deflected by one of the vanes V. The deflection of the air by the vanes creates an equal and opposite force reaction on the vanes which creates a net turning moment of the entire shade about a central vertical axis A. In a sense, the device acts much like a wind mill with the "wind" being created by the heat of the bulb. As described later, the shade is supported so as to be freely rotatable about vertical axis A so that the net turning moment will cause the entire shade and vane assembly to rotate in a counterclockwise direction as viewed from the top.

An important feature of the vanes may be seen in FIG. 1 by comparing the incidence angle of a typical vane V at its central portion 12 with the increased incidence angle near its outer periphery 11. Note the airflow is approximately normal to the vane surface near the center of the vane V and is angled substantially to the surface of the vane at the outer periphery of the vane at 11. Those familiar with efficient turbine blade design will recognize this varying angle of incidence in the radial direction as being important in taking into account the greater retreating velocity of the vanes near the outer periphery.

An important feature of the overall conical shape of the shade is that the diverging conical section, in the upward direction, will cause the velocity of the air flow to increase as it rises. The velocity of the air as it impinges on the turbine vanes is directly proportional to the rotational impulse delivered to the vanes. The conical constriction cannot be made too severe, however, because the area at the top would become too small to hold effective sized vanes.

The final rotational speed will be achieved when the net turning moment of the rising hot air is just balanced by the rotational resistance offered by needle bearing assembly 30 and the frictional wind resistance of the shade. Of course the turning speed could be adjusted by using different wattage lamp bulbs. The artisan will see many other ways of adjusting the rotational speed such as by skewing the vanes so as to present a different angle of incidence to the airflow. Also, a portion of the incoming air stream at the bottom 15 of the shade could be obstructed or a few of the vane outlets could be plugged.

Shade and vane portion 10 is formed from a single sheet of thin pliable material. Paper has proved adequate, although plastics and still other materials could be employed. In fact, papers containing a certain clay content have exhibited superior resistance to flammability, compared to most plastics available in sheet form.

Shade 10 performs a conventional role in limiting or blocking excessive or bright light emanating from bulb 7. As seen in FIG. 1, shade 10 is preferably imprinted with an ornamental design.

Figure 3:
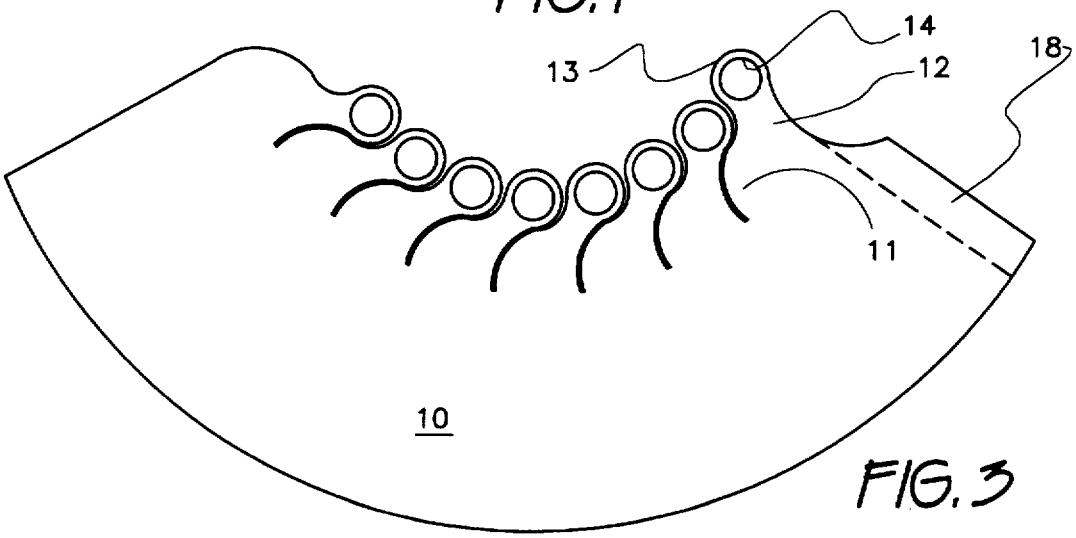
FIG. 3 is a layout of a flat pliable piece of material which can be properly formed to create the shade and vane portion of the invention.

FIG. 3 shows a layout of the flat sheet as it is shaped and cut prior to forming into a shade. The shapes can be stamped or die cut from flat sheets of stock material. Generally a circular frustrum arc is formed with a series of identical ears 13 facing the center of the overall arc. Each ear is pierced with a circular aperture 14 as seen in FIG. 3. The sides of the ears are formed as S-shaped curves and lie adjacent one another in the flattened mode. It will be noted the series of circular apertures 14 also lie upon a circular arc in the flattened condition.

When the shade is created the individual circular apertures are pulled so as to lie atop one another in a collinear relationship. This in turn deforms the remaining portion of the blank into the frustroconical shape of FIG. 1. The individual ears form the vanes of the finished structure and the aligned circular apertures are fastened together with a rivet assembly 20. Rivet assembly 20 comprises a rivet having an expanded head which occupies the aligned circular apertures, the longitudinal dimension of the rivet being arranged vertically and generally coinciding with the axis of rotation of shade and vane portion 10.

A small tab 18 is arranged to overlap the other side of the cone as the blank is deformed for gluing or otherwise fastening the two opposite sides together. This final fastening permanently holds the blank in the final frustoconical form. If desired, the frustoconical form can first be rolled up and the ears bent atop one another as a secondary step.

An advantage gained from forming the shade and vanes from a single sheet of material is that all corners and crevices naturally deform to the shape of minimal internal stress. These minimum stress curvatures are gentle and also form ideal flow paths for a fluid. This allows the convective air to flow smoothly (laminar flow) throughout the interior of the device without turbulence. The lack of turbulent energy loss also tends to increase the efficiency of my device for turning bulb heat into physical rotation.

Another advantage of the single sheet construction of the shade and vanes is the inexpensive nature of the entire process. A multitude of shades and vanes can be made from a single sheet of stock material. There is no supporting frame, external or internal, required as the formed structure is sturdy and relatively rigid, even when made from paper or cardboard.

Another advantage of the single sheet construction of the shade and vanes is the natural swept back contour imparted to the vanes. The advantages of changing the angle of attack of the vanes in the radial direction have been discussed above.

Figure 2:
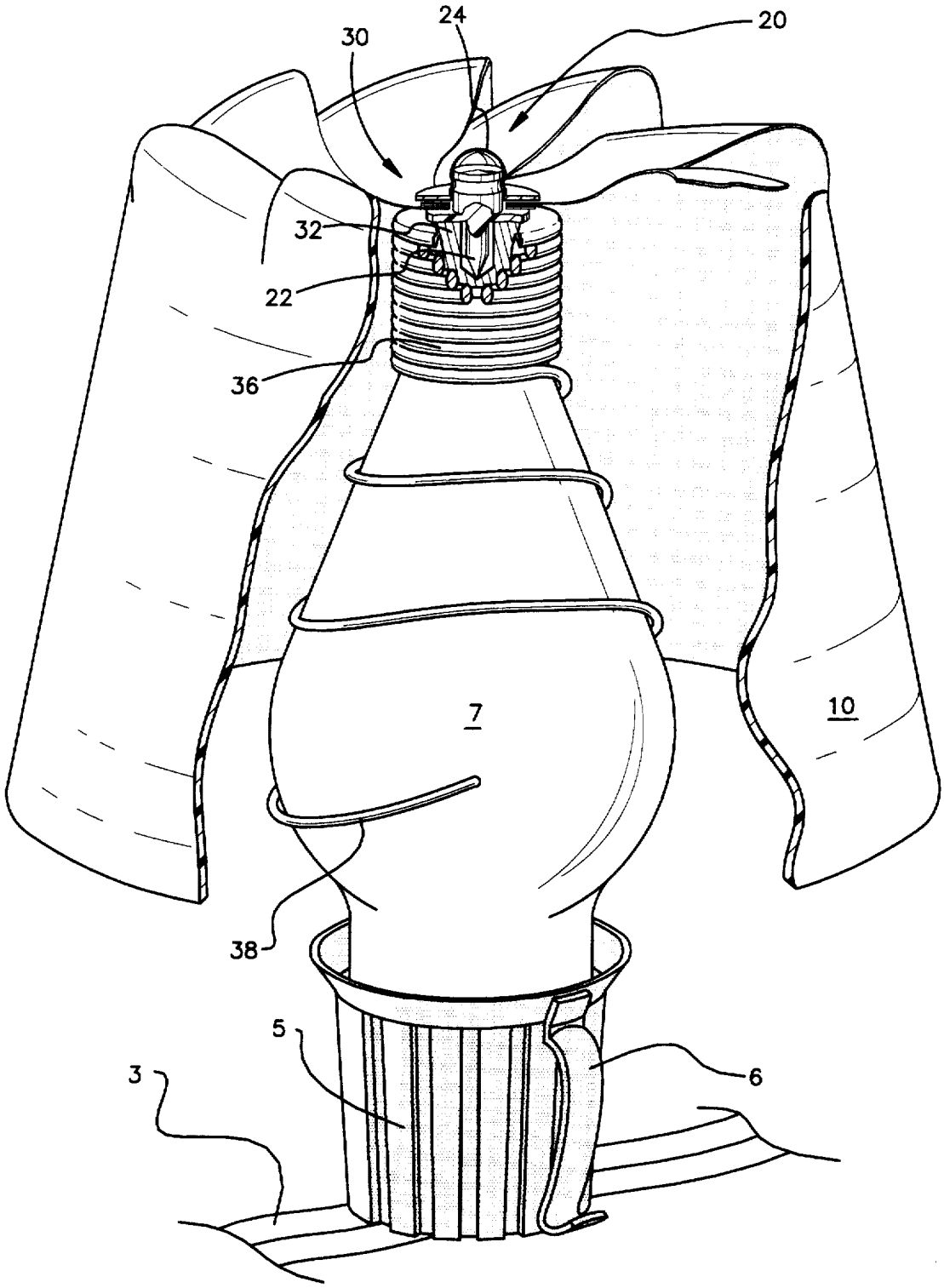
FIG. 2 is an environmental view of the invention, partially broken away and drawn to enlarged scale.

As shown generally in FIG. 2, shade and vane portion 10 is supported from needle 22, which needle 22 is seated in a bearing or cup 32 of needle support assembly 30. Needle 22 projects downwardly from rivet assembly 20, and contacts the upper floor surface 34 (see FIG. 4) of cup 32. An advantage of employing a rivet is that the rivet both secures the single sheet forming shade and vane assembly 10, and also has needle 22 formed integrally therewith. Rivets are commercially available, and thus a pre-existing article may be exploited to serve two purposes in construction of the invention. Needle support assembly 30 is covered by a protective or decorative cap 24.

Needle 22 provides a pivot fixed to shade and vane portion 10. Needle 22 occupies the central or rotational axis of shade and vane portion 10. Shade and vane portion 10 is thus rotatably or pivotally supported on bulb 7. Convection driven rotation proceeds when bulb 7 heats surrounding ambient air.

Cup 32 is removably entrapped within support assembly 30, which comprises a spiralled support spring. Cup 32 need not be adhered, welded or otherwise fastened. If such construction were required, careful orientation of cup 32 would be required during installation and replacement. Support assembly 30 has a tightly wound upper section 36 and an expanded lower section 38. Upper section 36 receives and retains cup 32. Upper section 36 easily distends under manual pressure to receive, conform to, and release cup 32 during insertion and removal of cup 32. Lower section 38 clings to bulb 7, and is expanded to avoid unduly obstructing light.

An important feature of lower section 38 is the fact that its inward spiral makes it adaptable to perch atop bulbs of a wide variety of shapes and sizes. No matter what diameter bulb is involved, there will come a point where the spiral will just mesh with that diameter. The resilient nature of the spring material will permit it to expand slightly, at that mesh point, and grip the bulb firmly.

Figure 4:
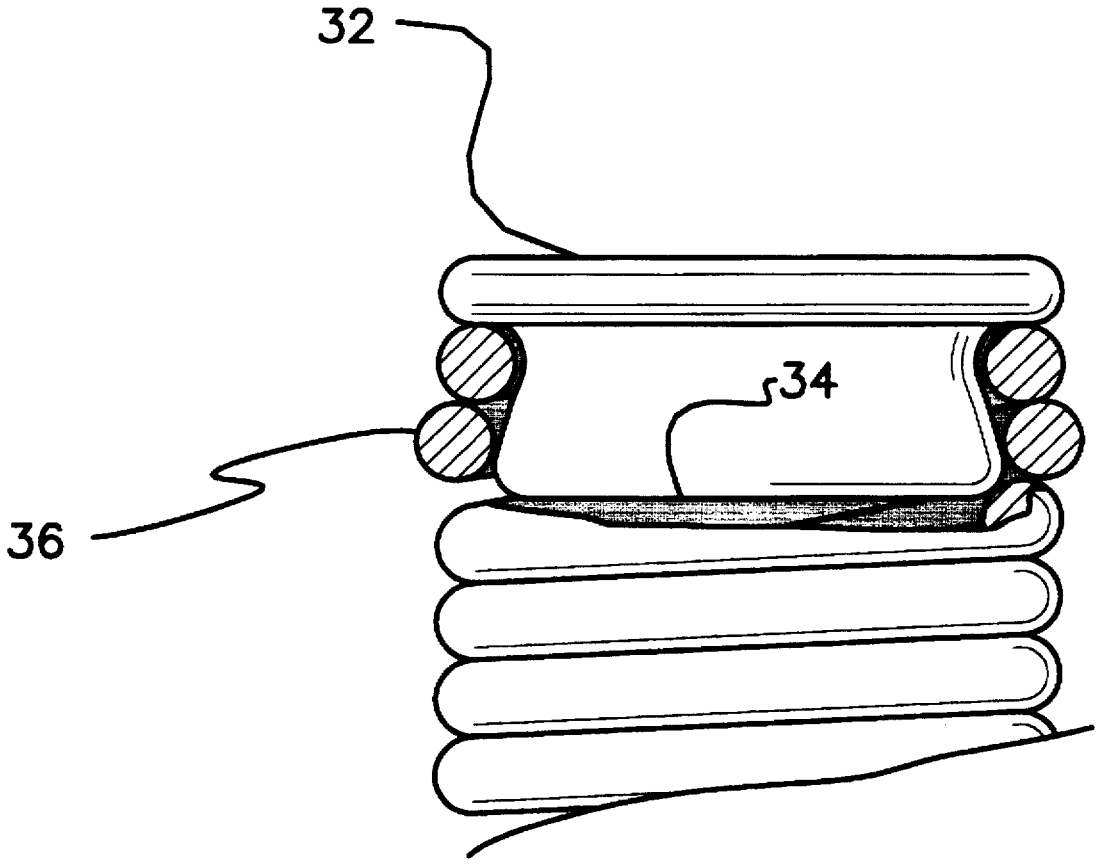
FIG. 4 is a side elevational detail view taken from the top of FIG. 2, shown partially in cross section.

FIG. 4 shows retention of cup 32 by support assembly 30 in greater detail. Cup 32 resiliently snap fits into upper section 36 of support assembly 30. It will be apparent from examination of FIG. 4 that when shade assembly 10 is lifted therefrom, there is no exposed sharp point which could injure a person. Also, surface 34 is sufficiently broad or wide to accommodate some inclination of bulb 7 (see FIG. 2) while still seating the point of needle 22. When surface 34 is horizontal, needle 22 can travel randomly thereover, which would mitigate a possible tendency of the point of needle 22 to bore through surface 34. This characteristic contrasts with partially spherical or conical configuration seen in the corresponding bearing surfaces in the prior art.

The artisan will note that the single point suspension of the shade will cause the center of gravity of the shade to lie directly below the needle point regardless of the direction the needle is pointed. This means the shade will hang perfectly vertical even if the bulb and attached spring and needle are canted. The convective currents, generated by the heat of the bulb, are also perfectly vertical in the absence of outside drafts. Thus it may be seen the shade, with its integral vanes, is always precisely aligned to take maximum advantage of the feeble energy available in the convective currents generated by a low wattage bulb.

It is noted the needle and support assembly provide a path for heat conduction which allows heat energy to be removed from the bulb without performing the desired function of heating air. However, the minuscule conduction area provided at the needle point renders this effect negligible.

I prefer to use paper having clay content for my shade and vane material. Such a material is easy to decorate with various forms of colorful art work so as to improve the esthetic impact of the device. Of course, it will be recognized that many materials could be used for the shade, the primary requisite being the pliability required to roll and bend a blank sheet to the final form. It would also be possible to construct a die of the final form and then make multiple shades from the die. With this approach, production costs can be held to an absolute minimum.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily determine how to change the conical divergence of the air flow or the number of turbine vanes by making simple changes to the layout blank.

It is to be understood that the present invention is not limited to the sole embodiment described above, but encompasses any and all embodiments within the scope of the following claims:

I claim:

1. An ornamental cover for diffusing the light emanating from an incandescent bulb, comprising;

shade means, formed generally as a translucent frustoconical surface with an open large end and a smaller capped end, surrounding the bulb so as to completely hide the bulb from view and passing an appreciable portion of the light emanating from the bulb;

mounting means for removably supporting said shade means upon said bulb and having bearing means enabling free rotation of said shade about a central vertical axis of said shade means, said mounting means comprising a spiralled wire having a first coiled section engaging the bulb and and a second coiled section receiving said bearing means, and wherein said bearing means comprises a cup releasably secured within said second coiled section of said spiralled wire;

vane means formed integrally with said shade means and forming a cap over said smaller capped end of said frustoconical surface; and pivot means having a needle fixed to said vane means and to said shade means, said pivot means disposed within said cup and on said central axis, said pivot means projecting downwardly from said vane means and said shade means, and said pivot means rotatably supporting said vane means and said shade means on the bulb by pivoting contact with said bearing means, whereby heat created by the bulb warms the surrounding air and causes a convective air current to flow upwardly into said open large end, and outwardly past said vanes from said smaller capped end, thus causing said cover to rotate about said central vertical axis.

2. The ornamental cover of claim 1, wherein said shade means is imprinted with an ornamental design.

3. The ornamental cover of claim 1, wherein said shade means and said vane means formed integrally with said shade means are both formed from a single flat sheet of flexible material which is cut into a pattern and deformed into a final capped frustoconical shape, and said vane means is formed from a series of ears cut into said pattern with each ear having a separate aperture and with all said apertures being aligned in said final frustoconical shape and with each said ear forming an individual vane of said vane means.

4. The ornamental cover of claim 3, wherein said pivot means further comprising rivet means holding said aligned apertures together, said pattern including a tab one one side which overlaps another side of said pattern in said final frustoconical shape so as to provide a securement area between the sides through a tab fastening means, wherein said rivet means and said tab fastening means together serve to permanently hold said shade means in said final frustoconical shape.

5. The ornamental cover of claim 3, wherein each said individual vane has a varying angle of incidence with the upwardly flowing air current flows in a radial direction.

6. The ornamental cover of claim 1, wherein said second coiled section of said spring is tightly wound, positively receiving and retaining said cup, and said first coiled section of said spring is expanded, whereby said first coiled section effectively partially surrounds the bulb while enabling most light generated by the bulb to pass to said shade means.

7. The ornamental cover of claim 1, further comprising means for gravitationally aligning said shade means with the absolute vertical and for automatically aligning said shade means with the upwardly convective air current.

8. The ornamental cover of claim 1, said cup of said bearing means having a broad, flat floor surface, whereby inclination of the bulb is accommodated and random travel of said needle on said cup is enabled when said floor surface is horizontal.

* * * * *